US006439804B1

(12) United States Patent
Crupi

(10) Patent No.: US 6,439,804 B1
(45) Date of Patent: Aug. 27, 2002

(54) METHOD AND APPARATUS FOR CONTROLLING THE MIXING OF MILLED ASPHALT AGGREGATE WITH REJUVENATING FLUID

(76) Inventor: Francesco A. Crupi, 2845 Seabreeze Dr. South, Gulfport, FL (US) 33707

( * ) Notice: Subject to any disclaimer, the term of this patent is extended or adjusted under 35 U.S.C. 154(b) by 0 days.

(21) Appl. No.: 09/593,621

(22) Filed: Jun. 13, 2000

(51) Int. Cl.[7] ..... E01C 7/06; E01C 7/32; E01C 23/07

(52) U.S. Cl. ..... 404/75; 404/84.1; 404/90; 404/91; 404/92

(58) Field of Search ..... 404/72, 75, 84.1, 404/90, 91, 92; 222/64, 71; 106/273.1, 276

(56) References Cited

U.S. PATENT DOCUMENTS

| | | | | | |
|---|---|---|---|---|---|
| 3,989,401 | A | | 11/1976 | Moench | 404/95 |
| 4,124,325 | A | * | 11/1978 | Cutler | 404/75 |
| 4,256,414 | A | * | 3/1981 | Milligan | 404/79 |
| 4,272,212 | A | * | 6/1981 | Bauer, Jr. et al. | 404/72 |
| 4,300,853 | A | | 11/1981 | Jones | 404/92 |
| 4,317,642 | A | | 3/1982 | Wirtgen | 404/72 |
| 4,335,974 | A | | 6/1982 | Wirtgen | 404/92 |
| 4,780,022 | A | | 10/1988 | Ohiba et al. | 404/90 |
| 4,784,518 | A | * | 11/1988 | Cutler | 404/79 |
| 4,929,120 | A | * | 5/1990 | Wiley et al. | 404/77 |
| 4,933,853 | A | * | 6/1990 | Musil et al. | 364/424.07 |
| 5,000,615 | A | | 3/1991 | Murray | 404/75 |
| 5,002,426 | A | | 3/1991 | Brown et al. | 404/92 |
| 5,046,890 | A | | 9/1991 | Dickson | 404/90 |
| 5,219,450 | A | | 6/1993 | Thurk | 404/91 |
| 5,544,971 | A | * | 8/1996 | Huege et al. | 404/72 |
| 5,588,776 | A | * | 12/1996 | Swisher, Jr. et al. | 404/72 |
| 5,755,865 | A | * | 5/1998 | Lukens | 106/279 |

OTHER PUBLICATIONS

Francesco A. Crupi, co–pending U.S. patent application Ser. No. 09/592,398 entitled "Mixing Apparatus and Method for Blending Milled Asphalt with Rejuvenating Fluid," filed, Jun. 13, 2000, in its entirety.

Francesco A. Crupi, co–pending U.S. patent application Ser. No. 09/592,773 entitled "Asphalt Rake with Ride up Capability," filed Jun. 13, 2000, in its entirety.

* cited by examiner

*Primary Examiner*—Gary S. Hartmann
(74) *Attorney, Agent, or Firm*—Butler, Snow, O'Mara, Stevens & Cannada, PLLC

(57) ABSTRACT

A method and apparatus for controlling the mixing of asphalt aggregate with rejuvenating materials in an asphalt rejuvenating machine. According to the method, milled aggregate is discharged in a windrow of fixed width, and windrow height is compared to rejuvenating machine speed to determine a volume rate of material being processed. A processor controller calculates a required amount of rejuvenating fluid addition based on the volume rate being processed and a desired proportion of rejuvenating fluid to aggregate. The processor controller controls a sprayer which directs rejuvenating fluid at some point along a zone extending from a milling apparatus to a mixer.

5 Claims, 5 Drawing Sheets

METHOD AND APPARATUS FOR CONTROLLING THE MIXING OF MILLED ASPHALT AGGREGATE WITH REJUVENATING FLUID

FIELD OF THE INVENTION

This invention relates to apparatus for in situ rejuvenation of asphalt pavement. More particularly this invention relates to a method and apparatus for controlling the mixing of milled aggregate and rejuvenating fluid in such rejuvenation.

BACKGROUND OF THE INVENTION

Asphalt pavement consists essentially of an aggregate and sand mixture held together with a petroleum based binder, such as tar. With continued exposure to sun, moisture, traffic, freezing and thawing, asphalt surfaces degrade. The degradation is principally in the binder, rather than the aggregate and sand mixture which makes up the bulk of the asphalt. Also, much of the degradation occurs within the top two or three inches of the surface.

Traditionally, worn asphalt pavement was not restored but instead was torn up and replaced with new asphalt. This is a costly approach and creates a problem as to what to do with the torn up pavement. Accordingly, techniques and apparatus have been developed for restoring or rejuvenating the top few inches of an asphalt paved surface.

A typical road resurfacing apparatus has a heater for heating and softening the asphalt surface as it passes along the asphalt surface. Following the heater is a "rake" or "scarifier" which breaks up or "scarifies" the softened pavement. The scarified pavement is generally crushed or "milled", blended with rejuvenating fluid and optionally additional sand or aggregate and redeposited. The redeposited material is spread out and rolled to create a rejuvenated surface comparable in quality to the original surface before degradation.

In order to produce a rejuvenated surface of high quality, it is important to ensure that an appropriate amount of rejuvenation fluid is added. Generally, a core sample or several core samples are initially taken of the surface to be rejuvenated and a desired ratio of rejuvenation material to milled aggregate is analytically determined. Although the amount is relatively easy to determine, its control may prove difficult. Past asphalt rejuvenation machines have assumed a constant cutting or milling depth and a constant rate of machine travel in determining the rate of addition of rejuvenating fluid.

In practice, the machine speed may vary and as well, the depth of cut will generally vary because of surface irregularities and sloped surfaces. Accordingly, adding rejuvenation fluid at a rate based on constant speed and depth assumptions has produced rejuvenated surfaces with inconsistent properties.

It is an object of the present invention to provide a method and apparatus for more accurately controlling the mixing of asphalt aggregate with rejuvenating materials.

SUMMARY OF THE INVENTION

A method for controlling the mixing of asphalt aggregate with rejuvenating materials in an asphalt rejuvenating machine, said method comprising the steps of:

(i) dislodging a top layer of an asphalt paved surface;

(ii) passing a milling apparatus over the dislodged layer from step (i) to strip said top layer and break up the top layer of the asphalt paved surface to form a milled aggregate;

(iii) adding rejuvenating material to the milled aggregate;

(iv) transferring the milled aggregate to a mixer and blending the milled aggregate with said rejuvenating material to form a blended aggregate.

(v) discharging either the blended aggregate or the milled aggregate in a windrow of pre-determined width;

(vi) measuring the height of the windrow;

(vii) measuring a speed of travel of the asphalt rejuvenating machine;

(viii) comparing the height of the windrow with said speed and determining a volume rate of discharge from said mixer;

(ix) determining a desired rate of addition of the rejuvenating materials which corresponds to the volume rate of discharge and a pre-determined final composition; and, (x) adjusting a rate of addition of the rejuvenating material in step (iii) to correspond to said desired rate of addition from step (ix).

An asphalt rejuvenating machine has a transport structure movable along an asphalt surface, a power plant mounted to the transport structure for providing motive force for the transport structure and a heater mounted to the transport structure for heating the asphalt surface. A rake mounted to the transport structure travels behind the heater for scarifying the asphalt surface to produce a scarified surface. A milling apparatus is mounted to the transport structure for milling the scarified surface to form a milled aggregate and to present the milled aggregate to a mixer. A rejuvenating fluid supply system is mounted to the transport structure for supplying rejuvenating fluid to the milled aggregate. The machine includes a mixer for blending the milled aggregate with the rejuvenating fluid and depositing a blended aggregate thus formed in a windrow of pre-determined width. The machine further includes a speed sensor for measuring the speed of travel of the transport structure and a height measuring device for measuring the height of the windrow. The machine further includes a comparator for comparing the speed of travel with the height to determine a volume rate of discharge of the blended aggregate. A controller associated with the rejuvenating fluid supply system is provided to vary a volume rate at which the rejuvenating fluid is added, based on the volume rate of discharge and the pre-determined final composition.

The rejuvenating fluid supply system may include a rejuvenating fluid tank, a sprayer for spraying the rejuvenating fluid on the milled aggregate, a pump fluidly communicating with the rejuvenating fluid tank and the sprayer for delivering the rejuvenating fluid from the tank to the sprayer, and a flow meter for determining a volume flow rate of the rejuvenating fluid.

The speed sensor may be mounted on an axle of the transport structure.

The mixer or the milling apparatus may have a discharge opening with a guide for determining the pre-determined width of the windrow, and a levelling device which rides along a top surface of the windrow.

The comparator may be part of a central processor unit which receives input from the speed sensor, the height measuring device, an operator control panel and the fluid flow meter. The central processor unit may also act as the controller by sending an output to the pump.

DESCRIPTION OF THE DRAWINGS

Preferred embodiments of the present invention are described below with reference to the accompanying drawings in which.

DESCRIPTION OF PREFERRED EMBODIMENTS

Figure 1:
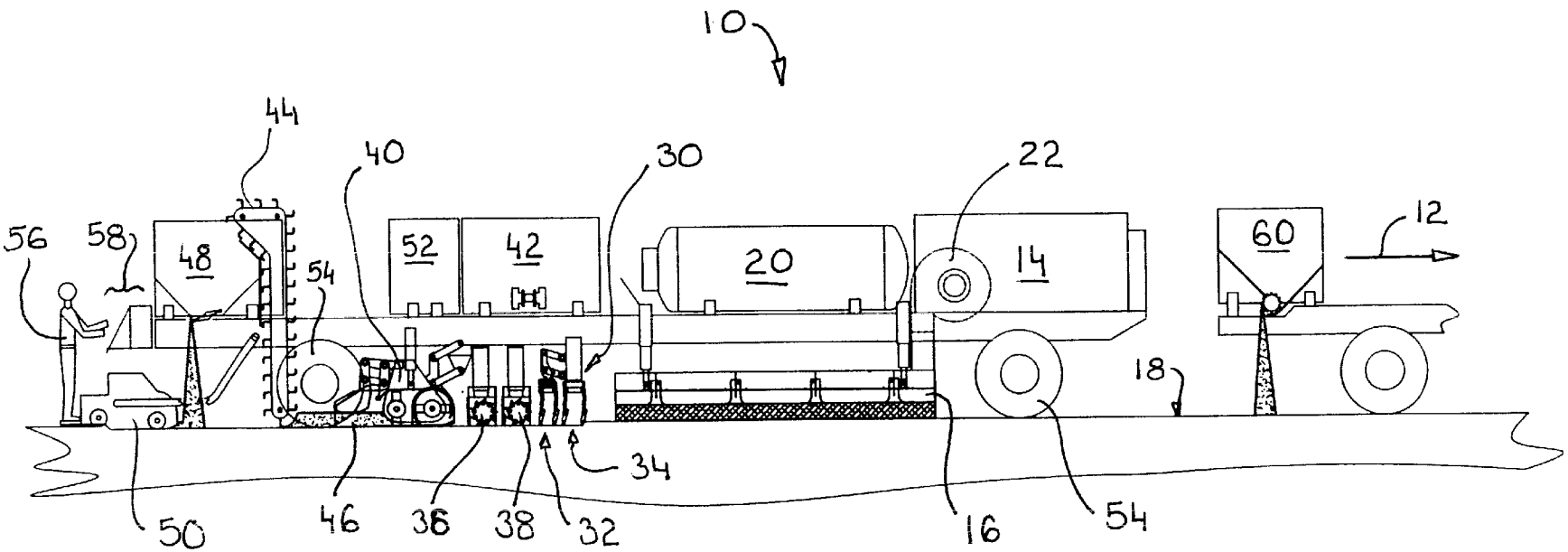
FIG. 1 is a schematic representation of an asphalt rejuvenating machine according to the present invention.

An asphalt rejuvenating apparatus is generally indicated by reference 10 in FIG. 1. The rejuvenating machine 10 travels in a path of travel indicated by arrow 12. The rejuvenating machine 10 has a transport structure 11 to which its various components are mounted. The transport structure 11 is basically a support frame having wheels or tracks 54. A power plant 14 at the front of the transport structure 11 is provided to drive the apparatus and typically includes an engine and a hydraulic system.

Behind the power plant 14 and also mounted on the transport structure 11 is a heater 16 which includes numerous burners and associated plumbing for heating an asphalt surface 18 upon which the rejuvenating apparatus 10 travels. A propane (or other combustible fuel) tank 20 and a combustion blower 22 would typically be provided. The heater 16 directs heat at the asphalt surface 18 to cause softening of an upper part of the asphalt surface 18.

The softened asphalt surface 18 is initially dislodged by a raking device, generally indicated by reference 30, mounted to the transport structure 11, and which follows the heater 16. The raking device 30 has rakes which dislodge the heated asphalt surface 18. The raking device 30 may include main rakes 32 and extension rakes 34, the extension rakes 34 performing a similar function to the main rakes 32, but to the outside edges. The main rakes 32 break up material around manholes where a main mill 36 behind the raking device 30 cannot run.

The main mill 36 which is mounted to the transport structure 11 behind the raking device 30 grinds up the material dislodged by the rakes, levels the underlying surface and prepares the surface to a preset depth. Extension mills 38 ahead of the main mill 36 perform a similar function, but process outer material typically from 10 to 15 feet to each side of the rejuvenating apparatus 10 and move it to a central part of the rejuvenating apparatus 10 where it is subsequently processed by the main mill 36.

A pug mill 40, also mounted to the transport structure 11, follows the main mill 36 and acts as a mixer for blending the processed material from the main mill 36 with rejuvenating fluid from a tank 42. Blended material 46 from the pug mill 40 is picked up by a scalping conveyor 44 which deposits the blended material 46 in a heated holding hopper 48. The holding hopper 48 keeps the blended material 46 hot until it is needed. The holding hopper 48 may be filled through its top with material for start ups or if additional material is needed. The holding hopper 48 may also be dumped if required or at the end of a day's operation.

A screed 50 follows the asphalt rejuvenating apparatus 10 and may be a unit such as typically found on an asphalt paver. The screed 50 lays, spreads and slightly compacts the blended material 46 for final rolling.

A water system 52 may be provided to supply cooling water to the front and rear tires or tracks 54.

An operator 56 operates a control and processing station 58. From initial core samples the amount of rejuvenating fluid, sand and aggregate required to bring the asphalt surface 18 up to a suitable specification can be determined. The operator 56 can input and monitor the amounts of rejuvenating fluid, sand and aggregate being added.

A sand/aggregate bin 60 precedes the asphalt rejuvenating apparatus 10. The sand/aggregate bin 60 may be attached to the asphalt rejuvenating apparatus 10 or attached to a separate machine (not shown) running in front thereof. Sand/aggregate is metered at a specific rate which is a function of ground speed and specification requirements.

Figure 2:
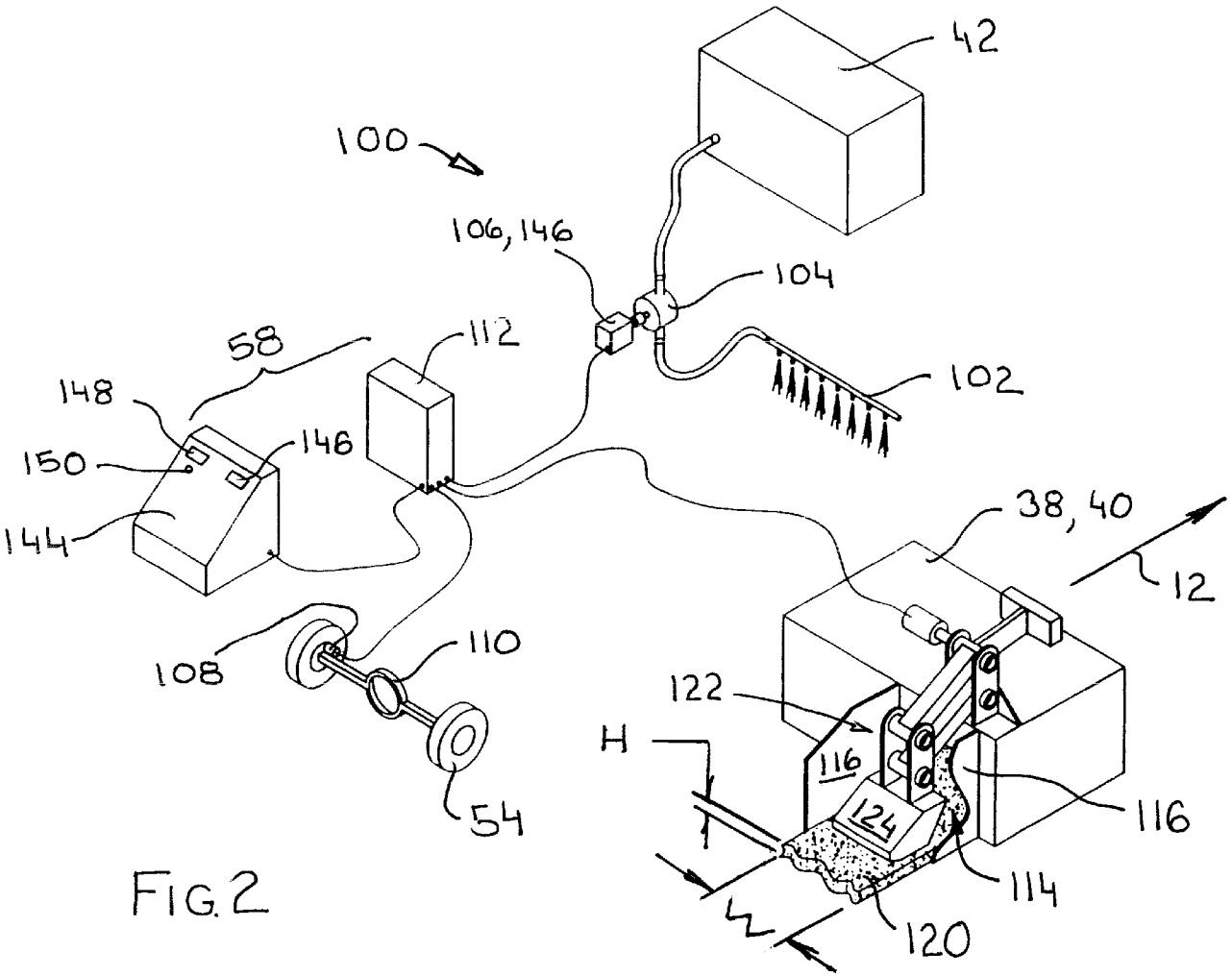
FIG. 2 is a schematic representation of the components of an asphalt rejuvenating machine according to the present invention which relate to a method for the controlling of the mixing of asphalt aggregate according to the present invention.

The rejuvenating fluid is supplied by a rejuvenating fluid supply system generally indicated by reference 100 in FIG. 2. The rejuvenating fluid supply system 100 includes the rejuvenating fluid supply tank 42 and further includes a sprayer 102, a pump 104 for delivering rejuvenating fluid from the supply tank 42 to the sprayer 102 and a flow meter 106 for measuring a volume flow rate of the rejuvenating fluid.

The sprayer 102 may be located at the main mill 38, between the main mill 38 and the pug mill 40 or at the pug mill 40. The sprayer 102 delivers rejuvenating fluid to the milled aggregate for final blending with the milled aggregate in the pug mill 40.

A speed sensor 108 is mounted to an axle 110, typically a drive axle of the transport structure 11 in FIG. 1. The speed sensor measures the speed of the transport structure 11 and sends a signal to a central processing unit 112 which is part of the control and processing station 58.

In order to determine an accurate rate at which rejuvenating fluid should be added, the asphalt rejuvenating machine 10 continually monitors the throughput of milled material. The volume throughput can be determined by multiplying the cross-sectional area of milled aggregate or blended aggregate emanating from the main mill 38 or pug mill 40 by the speed of the transport structure 11. To facilitate the measuring of the cross-sectional area, the main mill 38 or pug mill 40 may be provided with a discharge opening 114 having guides 116 a pre-determined distance apart. The guides 116 cause the milled or blended aggregate to be discharged in a windrow 120 of substantially constant width W.

If the width is a known constant, the only variable that needs to be measured to determine cross-sectional area of the windrow 120 is its height H. Accordingly, a height measuring device 122 is provided for measuring the height H of the windrow 120. Various height measuring devices 122 may be used. FIGS. 3 through 6 show representative examples.

Figure 3:
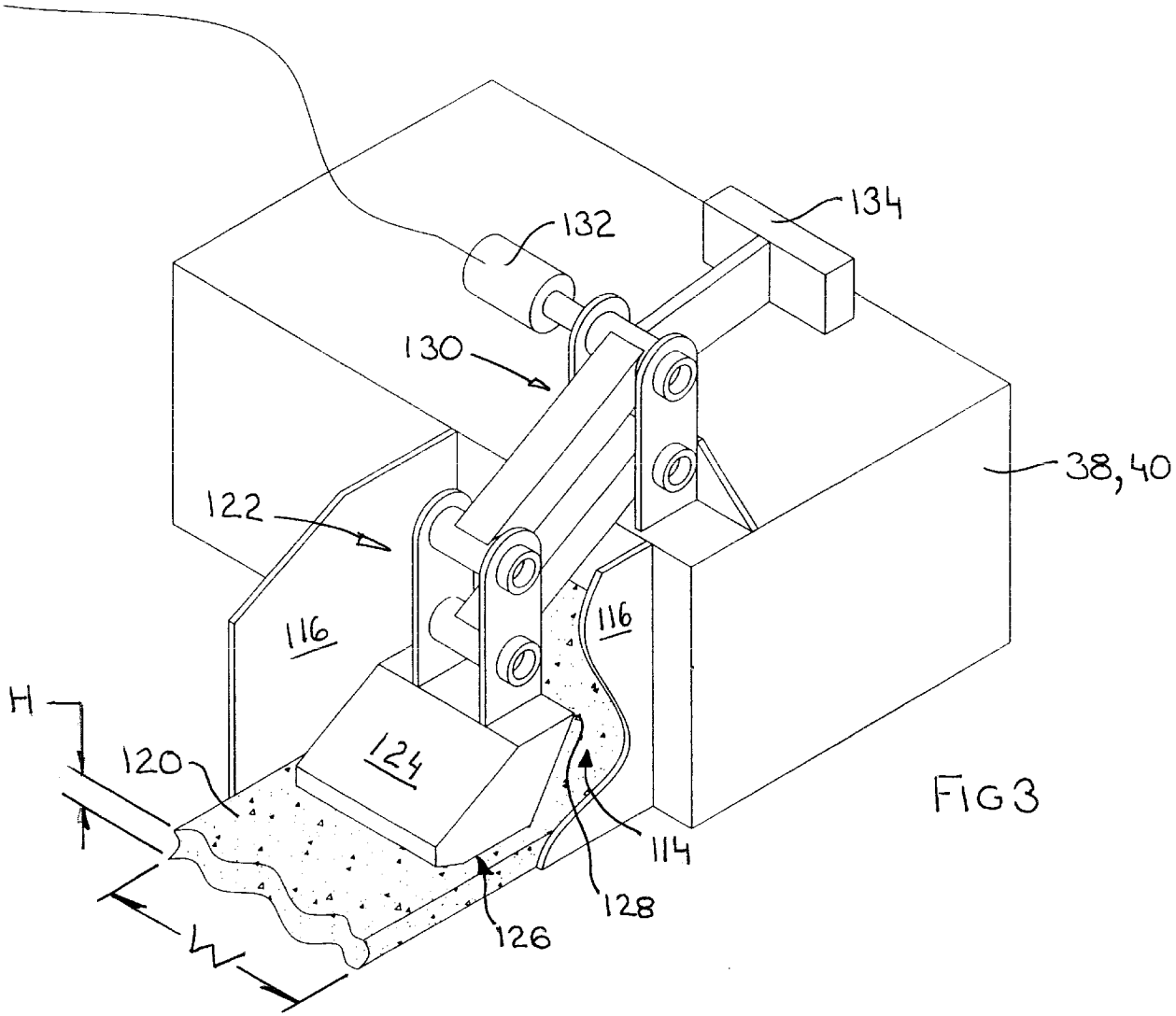
FIG. 3 is a perspective view illustrating a height measuring device according to the present invention.

In the FIG. 3 variant a "shoe" 124 substantially spans the breadth of the discharge opening 114 and levels the windrow 120 as it rides upon the windrow 120. The shoe 124 has a base 126 which inclines upwardly toward a front end 128 thereof. A parallel bar linkage 130 mounts the shoe 124 to the main mill 38 or pug mill 40. Although this is likely the most convenient mounting location this should not be interpreted restrictively. For example, a separate mounting bracket might be used extending from the transport structure 11.

A height transponder 132 is mounted to the parallel bar linkage 130 to send an electronic signal to the central processing unit 112 in response to vertical movement of the shoe 124 which is indicative of windrow height. A counterweight 134 may also be provided to reduce the downward force exerted by Palo the shoe 124.

Figure 4:
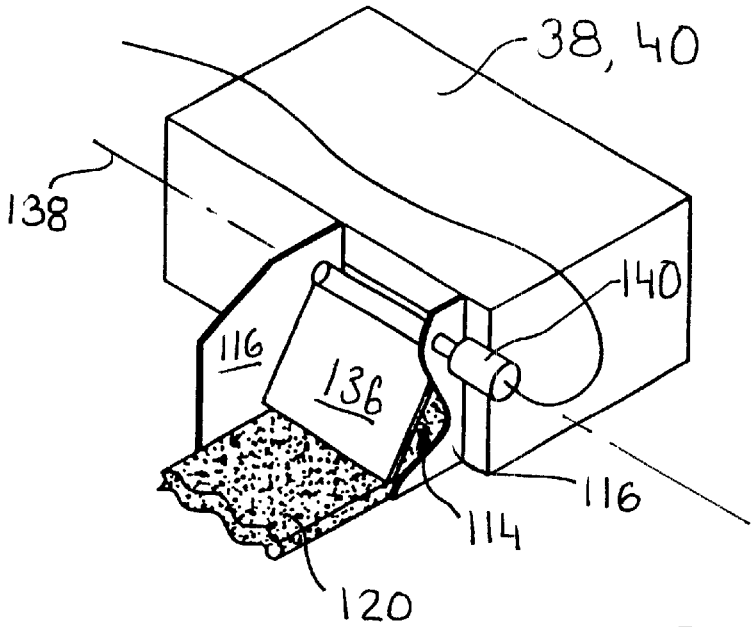
FIG. 4 is a perspective view of an alternate embodiment of a height measuring device according to the present invention.
Figure 5:
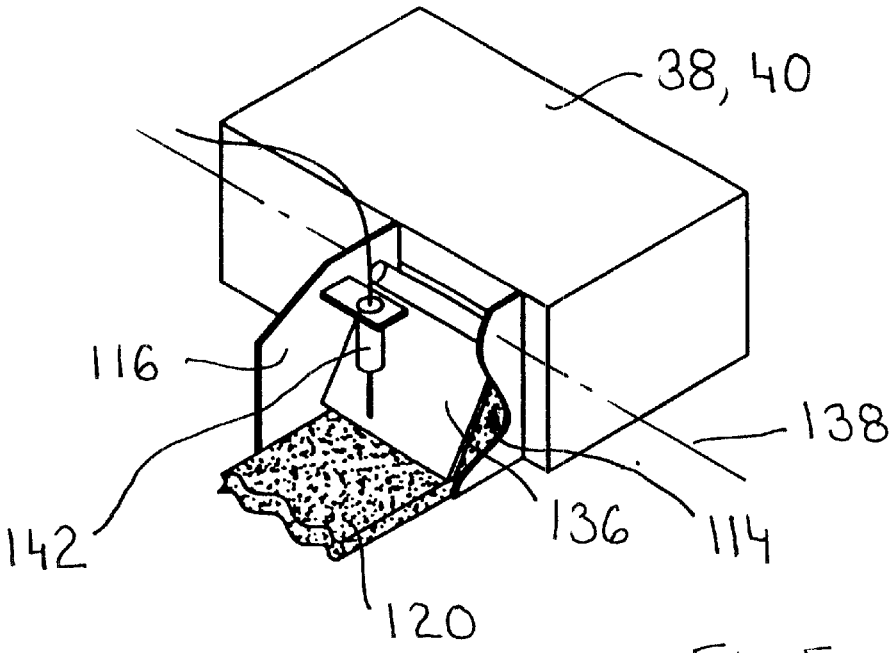
FIG. 5 is a perspective view of another alternate embodiment of a height measuring device according to the present invention; and, FIG. 6 is a perspective View of yet another alternate embodiment of a height measuring device according to the present invention.
Figure 6:
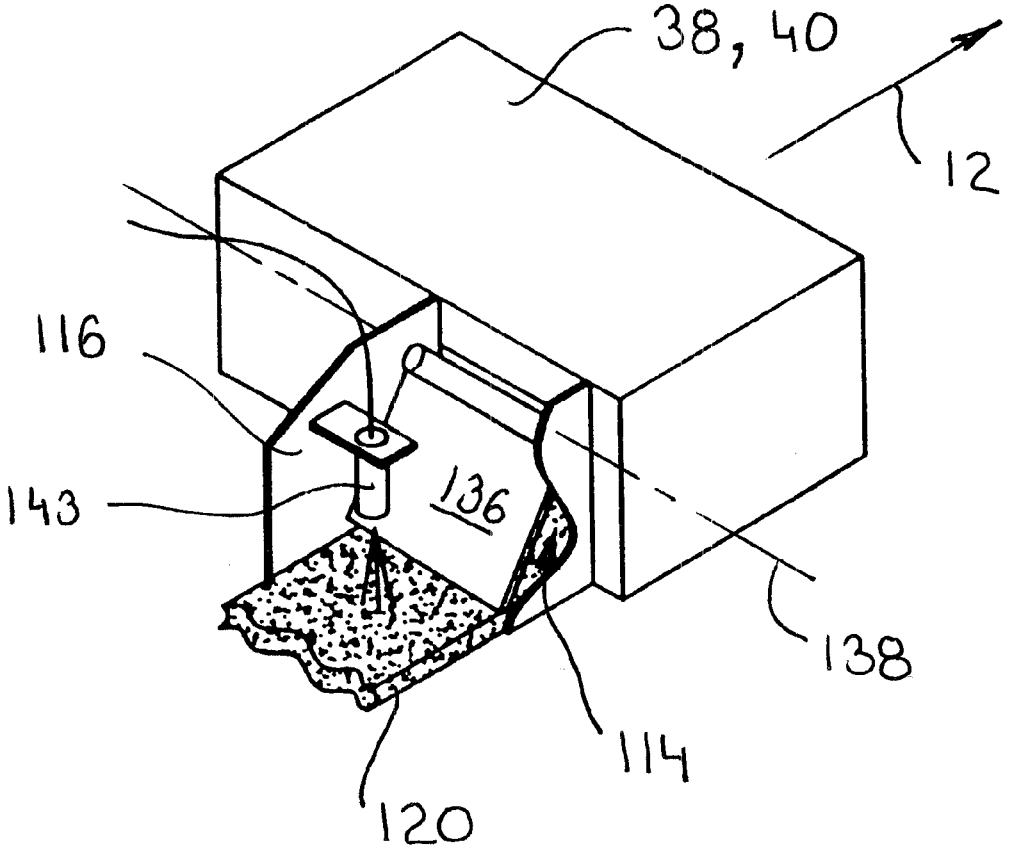

FIGS. 4 through 6 illustrate alternate embodiments for a height measuring device 122 which are similar in that they utilize a flap 136 extending across the discharge opening 114 as a levelling device instead of the shoe 124. The flaps 136 are mounted so as to be pivotable about an axis 138 extending across the discharge opening 114 in a direction transverse to the travel direction of the asphalt rejuvenating machine.

In the FIG. 4 embodiment, the height sensor is an angular displacement transducer 140 which senses the angular position of the flap 136 and sends an electronic signal to the central processing unit 112 in FIG. 2 (not shown in FIGS. 3 through 6) indicative of windrow height H.

The FIG. 5 embodiment is very similar to the FIG. 4 embodiment except that it uses a linear displacement transducer 142 rather than the angular displacement transducer 140 of the FIG. 4 embodiment.

The FIG. 6 embodiment also has a flap 136 but utilizes an ultrasonic (ie., sound speed) or laser (ie., light speed) depth sensor 143 rather than a displacement sensor and targets the windrow 120 itself rather than the flap 136 or shoe 124. The depth sensor 143 sends a signal to the central processing unit 112 indicative of windrow height H.

As will be apparent to persons skilled in apparatus for measuring depth or heights, various arrangements are possible and the above described embodiments should only be considered as a representative sample. For example, an ultrasonic or laser transducer could be mounted directly to the transport structure 11 or used instead of the transponder 132 in the FIG. 3 embodiment.

The central processor unit 112 acts as a comparator which receives input from the height measuring device, an operator control panel 144 and the fluid flow meter 104. The central processor unit 112 also acts as a controller by sending an output to a flow regulator 146 which may be associated with the flow meter 106, to regulate the flow of rejuvenating fluid provided by the pump 104 to the sprayer 102.

It will be apparent to those skilled in flow regulation devices that various flow regulator arrangements could be used. For example, a pump may be used having a proportional motor or a valve or pressure regulator could be used in combination with a flow meter. Basically any combination of devices which pump rejuvenating fluid, measure fluid flow and provide feedback to control the flow are candidates.

The operator control panel 144 may be arranged as desired however it should preferably include a display for actual rejuvenating fluid flow 146, a display for desired rejuvenating fluid flow 148 and an operator input set point display and adjustment control 150.

The above description is intended in an illustrative rather than a restrictive sense. Variations, examples of which are suggested above, may be apparent to persons skilled in such equipment and methods without departing from the spirit and scope of the invention as defined by the claims set out below.

I claim:

1. A method for controlling the mixing of asphalt aggregate with rejuvenating materials in an asphalt rejuvenating machine, said method comprising the steps of:

(i) dislodging a top layer of an asphalt paved surface;

(ii) passing a milling apparatus over the dislodged layer from step (i) to strip said top layer and break up said top layer of said asphalt paved surface to form a milled aggregate;

(iii) adding rejuvenating material to said milled aggregate;

(iv) transferring said milled aggregate to a mixer and blending said milled aggregate with said rejuvenating material to form a blended aggregate (v) discharging one of said blended aggregate and said milled aggregate in a windrow of pre-determined width;

(vi) measuring the height of said windrow;

(vii) measuring a speed of travel of said asphalt rejuvenating machine;

(viii) comparing said height with said speed and determining a volume rate of discharge from said mixer;

(ix) determining a desired rate of addition of said rejuvenating materials which corresponds to said volume rate of discharge and a pre-determined final composition; and, (x) adjusting a rate of addition of said rejuvenating material in step (iii) to correspond to said desired rate of addition from step (ix).

2. A method according to claim 1 wherein:

said adding of said rejuvenating material in step (iii) is carried out at a location along a zone extending from said milling apparatus to said mixer.

3. A method according to claim 2 wherein said rejuvenating material includes at least a rejuvenating fluid.

4. A method for controlling the mixing of asphalt aggregate with rejuvenating materials in an asphalt rejuvenating machine, said method comprising the steps of:

(i) dislodging a top layer of an asphalt paved surface;

(ii) passing a milling apparatus over the dislodged layer from step (i) to strip said top layer and break up said top layer of said asphalt paved surface to form a milled aggregate;

(iii) adding rejuvenating material to said milled aggregate;

(iv) transferring said milled aggregate to a mixer and blending said milled aggregate with said rejuvenating material to form a blended aggregate;

(v) discharging one of said blended aggregate and said milled aggregate in a windrow of pre-determined width;

(vi) measuring the height of said windrow;

(vii) measuring a speed of travel of said asphalt rejuvenating machine;

(viii) comparing said height with said speed and determining a volume rate of discharge from said mixer;

(ix) determining a desired rate of addition of said rejuvenating materials which corresponds to said volume rate of discharge and a pre-determined final composition;

(x) adjusting a rate of addition of said rejuvenating material in step (iii) to correspond to said desired rate of addition from step (ix); wherein said adding of said rejuvenating material in step (iii) is carried out at a location along a zone extending from said milling apparatus to said mixer;

said rejuvenating material includes at least a rejuvenating fluid;

said height of said window is expressed as a first electronic signal;

said speed of travel is expressed as a second electronic signal;

said first and second electronic signals are sent to a processing controller;

said pre-determined final composition is input into said processing controller;

said processing controller compares said first and second signals to determine said volume rate of discharge in step (viii);

said processing controller compares said volume rate of discharge with said pre-determined final composition to determine said desired rate of addition in step (ix); and, said processing controller at least initiates said adjusting of said rate of addition in step (x).

5. A method as claimed in claim 4 wherein:

said rejuvenating material further includes at least one of sand and aggregate.

* * * * *

US006439804C1

(12) EX PARTE REEXAMINATION CERTIFICATE (5420th)

United States Patent

Crupi

(10) Number: US 6,439,804 C1

(45) Certificate Issued: Jun. 20, 2006

(54) METHOD AND APPARATUS FOR CONTROLLING THE MIXING OF MILLED ASPHALT AGGREGATE WITH REJUVENATING FLUID

(75) Inventor: Francesco A. Crupi, 2845 Seabreeze Dr. South, Gulfport, FL (US) 33707

(73) Assignee: Francesco A. Crupi, Gulfport, FL (US)

Reexamination Request:
No. 90/006,487, Dec. 18, 2002

Reexamination Certificate for:

| | |
|---|---|
| Patent No.: | **6,439,804** |
| Issued: | **Aug. 27, 2002** |
| Appl. No.: | **09/593,621** |
| Filed: | **Jun. 13, 2000** |

(51) Int. Cl.

| | |
|---|---|
| ***E01C 7/06*** | (2006.01) |
| ***E01C 7/32*** | (2006.01) |
| ***E01C 23/07*** | (2006.01) |

(52) U.S. Cl. ..... 404/75; 404/84.1; 404/90; 404/91; 404/92

(58) Field of Classification Search ..... 404/72, 404/75, 84.1, 90, 91, 92; 222/64, 71; 106/273.1, 106/276

See application file for complete search history.

(56) References Cited

U.S. PATENT DOCUMENTS

| | | | | |
|---|---|---|---|---|
| 3,970,404 | A | 7/1976 | Benedetti | 404/77 |
| 4,011,023 | A | 3/1977 | Cutler | 404/91 |
| 4,124,325 | A | 11/1978 | Cutler | 404/75 |
| 4,793,730 | A | 12/1988 | Butch | 404/77 |
| 4,946,307 | A | 8/1990 | Jakob | 404/91 |
| 5,044,819 | A | 9/1991 | Kilheffer et al. | 404/72 |
| 5,588,776 | A | 12/1996 | Swisher, Jr. et al. | 404/72 |
| 5,791,814 | A | 8/1998 | Wiley | 404/91 |
| 5,848,755 | A | 12/1998 | Zickell et al. | 241/65 |
| 5,938,130 | A | 8/1999 | Zickell | 241/65 |
| 6,220,782 | B1 | 4/2001 | Yares | 404/75 |
| 6,290,152 | B1 | 9/2001 | Zickell | 241/21 |

FOREIGN PATENT DOCUMENTS

| | | | |
|---|---|---|---|
| DE | 3731716 | A1 | 4/1988 |

OTHER PUBLICATIONS

Hot–in–Place brochure publicly distributed in 1997 ("1997 HIP Brochure," Exhibit 1.

Specifications by the Mich.Depmt of Transportation, Michigan Project STP 9674(004) dated Jun. 7, 1996 ("1996MDOT Specs," Exhibit 3).

*Primary Examiner*—Thomas B. Will

(57) ABSTRACT

A method and apparatus for controlling the mixing of asphalt aggregate with rejuvenating materials in an asphalt rejuvenating machine. According to the method, milled aggregate is discharged in a windrow of fixed width, and windrow height is compared to rejuvenating machine speed to determine a volume rate of material being processed. A processor controller calculates a required amount of rejuvenating fluid addition based on the volume rate being processed and a desired proportion of rejuvenating fluid to aggregate. The processor controller controls a sprayer which directs rejuvenating fluid at some point along a zone extending from a milling apparatus to a mixer.

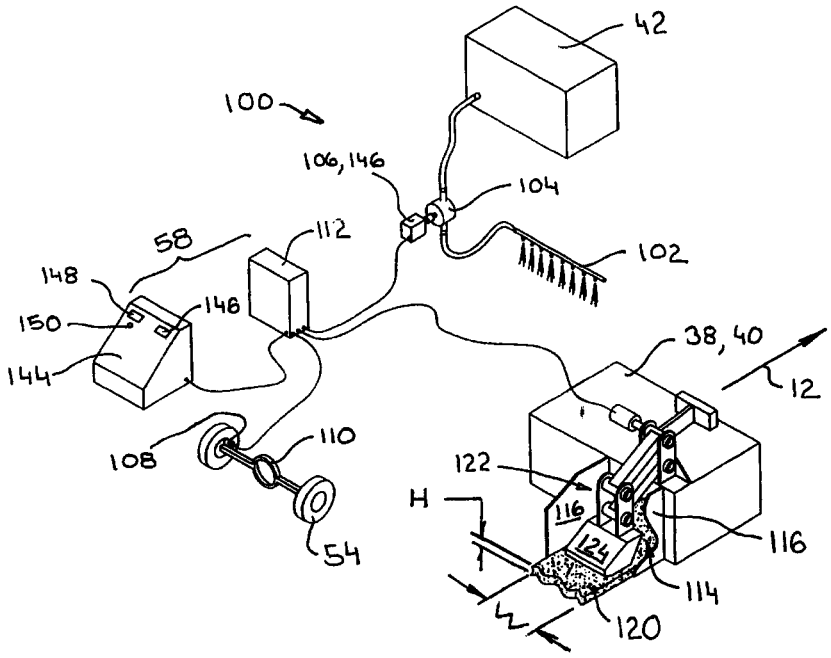

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–5 is confirmed.

* * * * *